United States Patent [19]

Motomura et al.

[11] 4,070,772

[45] Jan. 31, 1978

[54] GROUND EXCAVATING APPARATUS

[75] Inventors: Mitsuteru Motomura, Kamakura; Chiaki Kojima, Tokyo; Hiroshi Ohta, Chigasaki; Akira Nemoto, Tokyo, all of Japan

[73] Assignee: Kabushiki Kaisha Komatsu Seisakusho, Tokyo, Japan

[21] Appl. No.: 616,290

[22] Filed: Sept. 24, 1975

[30] Foreign Application Priority Data

| | | |
|---|---|---|
| Sept. 30, 1974 | Japan | 49-111409 |
| Sept. 30, 1974 | Japan | 49-111410 |
| Sept. 30, 1974 | Japan | 49-111411 |
| Sept. 30, 1974 | Japan | 49-111408 |

[51] Int. Cl.[2] ..... E07F 3/76

[52] U.S. Cl. ..... 37/117.5; 173/46; 175/315; 37/DIG. 3

[58] Field of Search ..... 37/117.5, DIG. 3, 103; 175/315; 173/34, 43, 45, 46, 90, 91, 114, 116; 214/131 R

[56] References Cited

U.S. PATENT DOCUMENTS

| | | | |
|---|---|---|---|
| 2,348,796 | 5/1944 | Ferwerda et al. | 37/117.5 X |
| 2,983,496 | 5/1961 | Grant | 175/315 X |
| 3,319,724 | 5/1967 | Cunningham | 173/46 X |
| 3,346,300 | 10/1967 | Grant | 173/43 X |
| 3,386,769 | 6/1968 | Wilmeth | 173/116 X |
| 3,458,396 | 7/1969 | Grant | 173/43 X |
| 3,460,691 | 8/1969 | Wieger et al. | 175/315 X |
| 3,586,113 | 6/1971 | Grant | 173/46 X |
| 3,782,484 | 1/1974 | Martin | 173/43 |
| 3,864,852 | 2/1975 | Lochrie | 37/141 R |

*Primary Examiner*—E. H. Eickholt
*Attorney, Agent, or Firm*—Armstrong, Nikaido & Marmelstein

[57] ABSTRACT

Such a ground excavating apparatus that conducts excavation of a soft stratum by means of a bucket and employs an impact crusher for the excavation of such a hard stratum as a rock bed or the like is disclosed.

Introduced in the present application is a ground excavator of such a category that comprises a housing, a bucket boom properly set in place in the said housing in a manner of being capable of traveling forward and rearward, a bucket properly fitted in place on the front end section of the said bucket boom in a manner of being capable of inclining, and an impact crushing mechanism well capable of traveling forward and rearward by virtue of a hydraulic jack housed in the said bucket boom, and employs the said bucket and the said impact crushing mechanism in an alternate manner to best suit the nature of the ground to be excavated.

8 Claims, 17 Drawing Figures

GROUND EXCAVATING APPARATUS

BACKGROUND OF THE INVENTION

The present invention relates to such a ground excavating apparatus as is suitable for excavating the heterogeneous ground consisting of hard and soft stratums including a rock bed and gravel.

The excavating apparatuses so far designed and manufactured for the purpose of conducting building of a tunnel or excavation of the ground are multifarious and diversiform, and are roughly classified into those of the bucket type proving suitable for excavating the soft ground and those of the impact crusher type proving suitable for excavating the comparatively hard ground.

The bucket type is such a type that generally conducts excavation of the soft ground by the operation of a bucket fitted in place on the top section of a bucket boom, hence unsuitable at all for the excavation of the hard ground. Meanwhile, the impact crusher type, on the part thereof, is what is applied to building of a tunnel in an extensive manner, and this category of ground excavating apparatus is what is employed for conducting excavation by cutting and crushing the face is a continuous manner without employing gunpowder, unlike the case of a blasting process.

The tunnel excavators presently employed are roughly classified into those of the total section cutting system and those of the partial section cutting system. The tunnel excavators of the partial section cutting system are those hitherto employed for excavating a coal mine and specifically remodeled for the purpose of conducting excavation for building a tunnel. The tunnel excavator of the total section cutting system are generally those employed for conducting excavation to a circular section. Multifarious models of tunnel excavators of the impact crusher type have been developed thus far, and have such common characteristics that generally cause the cutter thereof to be revolved, and to be given proper impellant force as well, for the purpose of conducting proper cutting or crushing of a rock.

However, for all the fact that the said bucket type and the said impact crusher type prove to be effective and efficient enough, in case the ground is well stabilized with a soft stratum and a hard rock bed, respectively, excavation by the employment of only either one of the said types is still impracticable or inefficient in the case of a general excavation work, since therein exist a variety of stratums in a mixed form as a reality.

SUMMARY OF THE INVENTION

In this case of the present invention, disclosed is such a ground excavator having the said two types properly combined therefor, wherein excavation of the soft ground is conducted by the employment of a bucket, while excavation of the hard ground, such as a rock bed or the like, is conducted by the employment of an impact crusher, thus proving well applicable for the excavation of the heterogeneous ground consisting of a soft stratum and a hard stratum.

To put it otherwise, one purpose of the present invention rests with providing such a ground excavating apparatus featuring a high level of efficiency as has overcome a series of defects inherent in the conventional type of ground excavating apparatus, another purpose of the present invention rests with providing such a ground excavating apparatus as is well applicable for excavating the heterogeneous ground consisting of both hard and soft stratums, including a rock bed and gravel, and still other purpose of the present invention rests with providing such a ground excavating apparatus of a new system, wherein the bucket-applied excavation type and the impact crusher-applied excavation type are properly combined into a single set of ground excavating apparatus.

Other purposes, features and advantages of the ground excavating apparatus introduced in the present invention will be made apparent enough readily through the following detailed description of certain preferred embodiments thereof given in conjunction with the accompanying drawings.

DETAILED DESCRIPTION OF THE PREFERRED EMBODIMENTS

Figure 1:
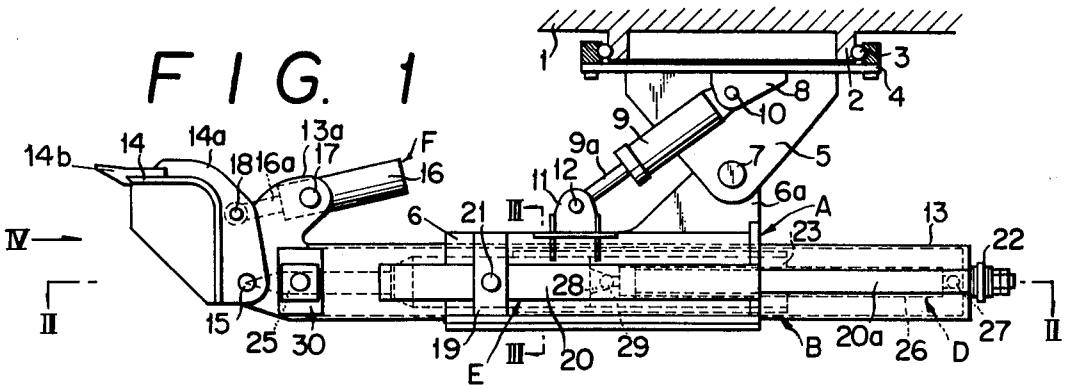
FIG. 1 is a partial sectional side view of an illustration of the present invention.
Figure 3:
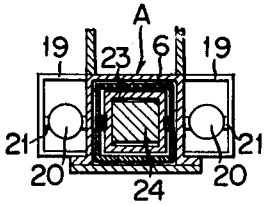
FIG. 3 is a sectional drawing viewed along the III—III line shown in FIG. 1.
Figure 2:
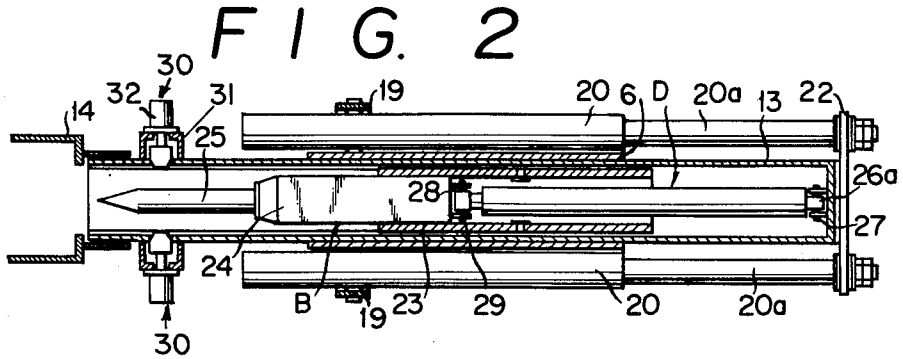
FIG. 2 is a sectional drawing viewed along the II—II line shown in FIG. 1.
Figure 4:
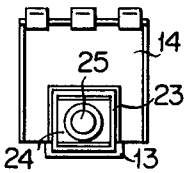
FIG. 4 is an elevation viewed from the direction of IV shown by an arrow in FIG. 1, FIG. 5 and FIG. 6 are explanatory drawings to show the actuation of the ground excavating apparatus introduced in the present invention.
Figure 5:
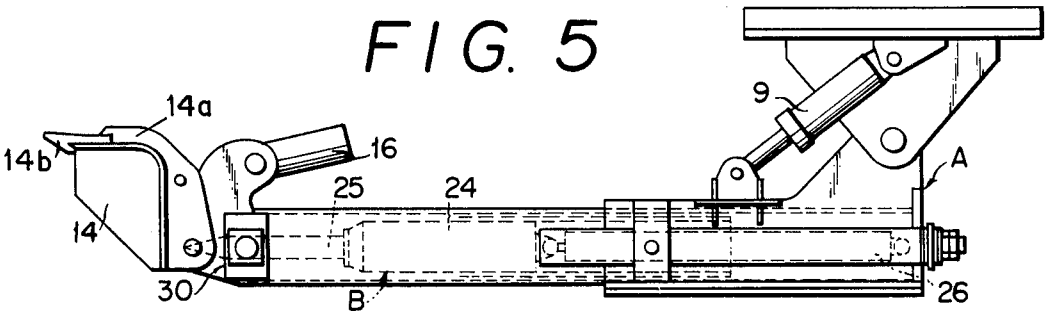
Figure 6:
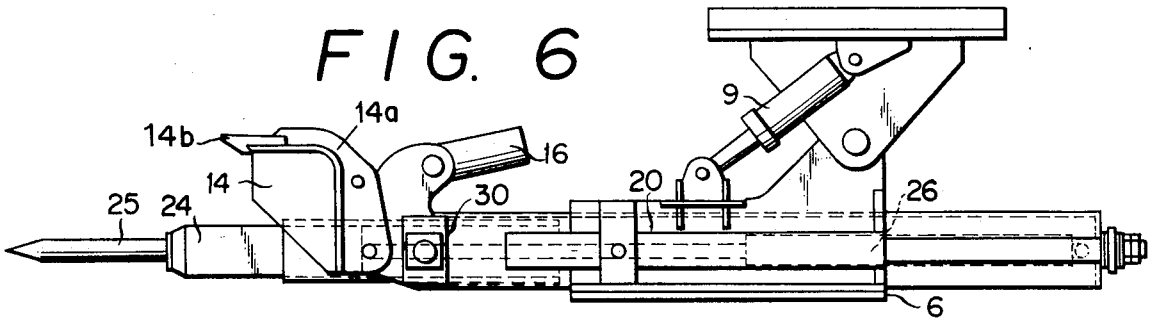
Figure 7:
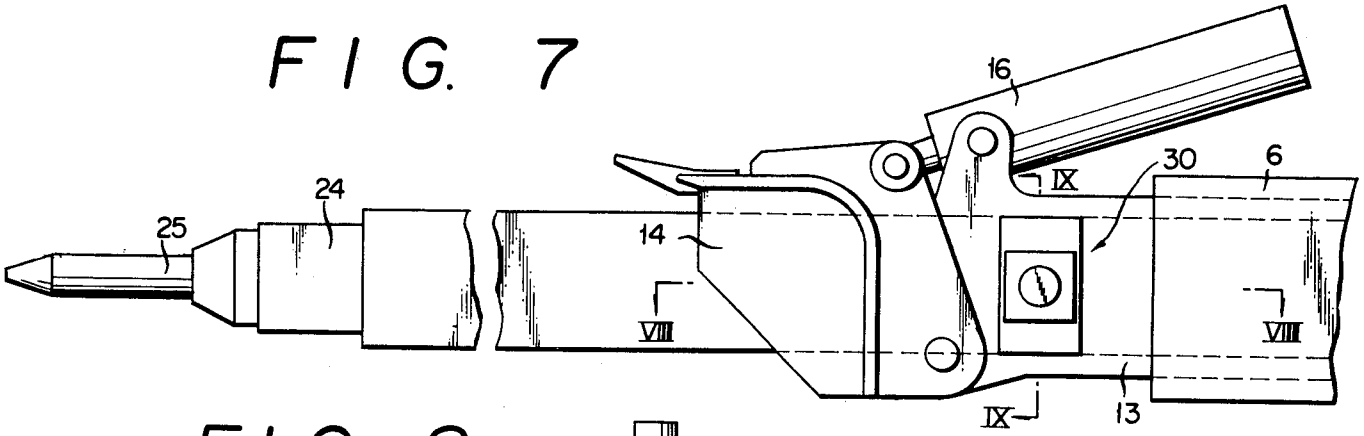
FIG. 7 is an enlarged side view of the bucket section.
Figure 8:
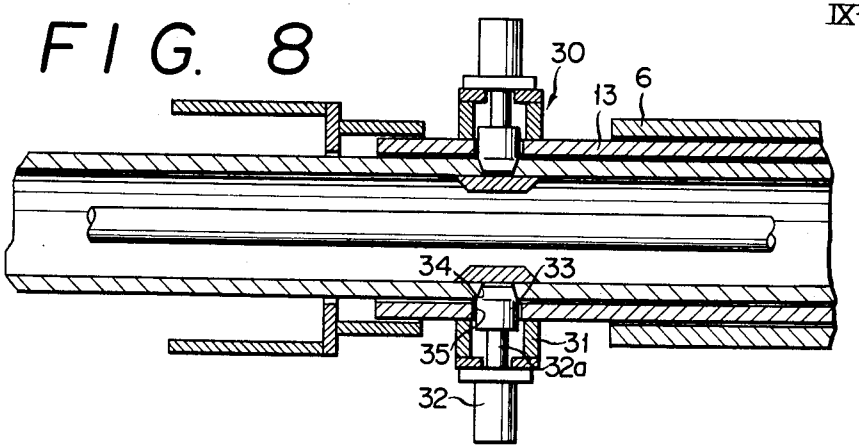
FIG. 8 is a sectional drawing viewed along the VIII—VIII line shown in FIG. 7.

A detailed description of the present invention will be given below by making reference to the drawings attached hereto. In the drawings, 1 is a fixed member, and formed on the said fixed member 1 is a ring-shaped seat 2 for conducting proper fitting. The said ring-shaped seat 2 for conducting proper fitting has a swivel seat 4 properly set in place thereon through a pivoted bearing 3. The said swivel seat 4 has a bracket 5 properly fixed in place thereon. The said bracket 5 has a projecting section **6*a* of a housing 6 constituting a support member A properly fitted in place by means of a pin 7. The said swivel seat 4 has a bracket 8 properly fixed in place thereon, and the said bracket 8 has the base end section of a jack 9 for actuating a boom to face upward or downward properly fitted in place thereon. The said housing 6 has a bracket 11 properly set in place on the front upper section thereof, and the said bracket 11 has a rod 9*a* of the said jack 9 for actuating the boom to face upward or downward by the employment of a pin 12. The said housing 6 has a bucket boom 13 properly fitted in place thereon in a manner of being capable of sliding, and the said bucket boom 13 has a supporting bracket 13***a* properly formed on the top side of the front end section thereof. And, the said bucket boom 13 has a rear bracket 14*a* for a bucket 14. The rear bracket 14*a* is pivotally fitted in place on the right side and the left side of the front end section of the bucket boom 13 by means of a pin 15.

The said supporting bracket 13*a* has such an inclined operation mechanism F for the bucket 14 as, for one thing, a bucket jack 16 properly fitted in place thereon by means of a pin 17, and a rod 16*a* of a bucket jack 16 is properly fitted in place on the said rear bracket 14a of the said bucket 14 by means of a pin 18.

The said housing 6 has supporting articles 19, 19 properly fixed in place on the right and left sides thereof, the said supporting articles 19, 19 have an operating mechanism E, for instance, sliding jacks 20, 20 properly fitted in place thereon by means of pins 21, 21, respectively, and the rods 20*a*, 20*a* of the said sliding jacks 20, 20 are properly connected with such a connecting bar 22 as is fixed in place on the rear end section of the said bucket boom 13, respectively.

The said bucket boom 13 has an impact crushing mechanism B properly set in place therein. The said impact crushing mechanism B is provided with such a guide boom 23 as is properly set in place in the said bucket boom 13 in a manner of being capable of sliding, the said guide boom 23 has an impact-generating mechanism 24 properly fixed in place thereon, and the said impact-generating mechanism 24 has a chisel 25 properly fitted in place on the movable side thereof. The said bucket boom 13 has such an operating mechanism D as, for one thing, a sliding jack 26 properly housed therein, a rod 26*a* of the said sliding jack 26 is properly fitted in place on the base end section of the said bucket boom 13 by means of a pin 27, and the base end section of the said sliding jack 26 is properly fitted in place on the bracket 28 on the rear end section of the said impact-generating mechanism 24 by means of a pin 29.

The said bucket boom 13 is provided with a locking mechanism 30 on the both sides of the front section thereof. The said locking mechanism 30 is provided with such a clamping jack 32 as is properly supported in place on the outside of the said bucket boom 13 by means of a bracket 31, and the rod 32*a* of the said clamping jack 32 has a clamping element 33 properly fixed in place thereon. And, the said bucket boom 13 has a through hole 35 for the said clamping element 33 to be engaged therewith in a manner of being capable of coming in engagement therewith properly formed thereon.

The said swivel seat 4 is properly designed in such a manner as to be swiveled by a swivel driving mechanism (not shown in the drawings).

And, in the case of excavating a soft stratum, the sliding jacks 20, 20 are actuated, the bucket boom 13 is thus caused to advance forward, the bucket 14 is caused to draw near to a proposed stratum, and the bucket jack 16 is so actuated as to subject the bucket 14 to rocking in a proper manner in the vertical directions, whereby excavation of the stratum is conducted by the employment of such excavating flukes 14*b* as are fitted with the bucket 14 at the forward end thereof.

Meanwhile, in the case of excavating such a hard stratum consisting of a rock bed, the sliding jack 26 is so actuated as to be extended in a proper manner, and the impact-generating mechanism 24 is so caused as to advance forward by means of the guide boom 23, whereby the chisel 25 is so caused as to advance forward in a proper manner. Then, the engaging groove 34 of the guide boom 23 and the through hole 35 of the bucket boom 13 are conformed with each other, and the clamping jack 32 is actuated in such a manner as to cause the clamping element 33 to be engaged with the engaging groove 34 through the said through hole 35, whereby the guide boom 23 is caused to be properly locked with the bucket boom 13.

The impact-generating mechanism 24 is actuated, in this state, and the proposed stratum is thus subjected to impact crushing in a proper manner by means of the chisel 25.

The chips of the soft stratum thus excavated and/or the chips of the hard stratum thus crushed are raked together by means of the bucket 14. To put it otherwise, the said jack 9 for actuating the boom to face upward or downward is put in actuation in the state of having the bucket boom 13 properly extended, thus causing the bucket 14 to be transferred as far as to the position of the said excavated and/or crushed chips, the bucket jack 16 is actuated, the sliding jack 20 is extended and the bucket boom 13 is contracted in a concurrent manner, and the said jack 9 for actuating the boom to face upward or downward is also concurrently actuated, whereby raking the said excavated and/or crushed chips together by the employment of the said bucket 14 is thus properly conducted.

Figure 10:
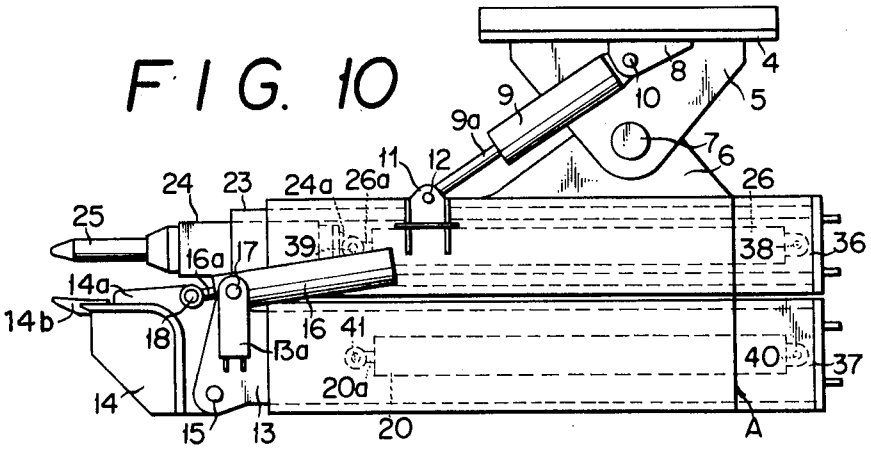
FIG. 10 is a side view of another illustration of the present invention.
Figure 12:
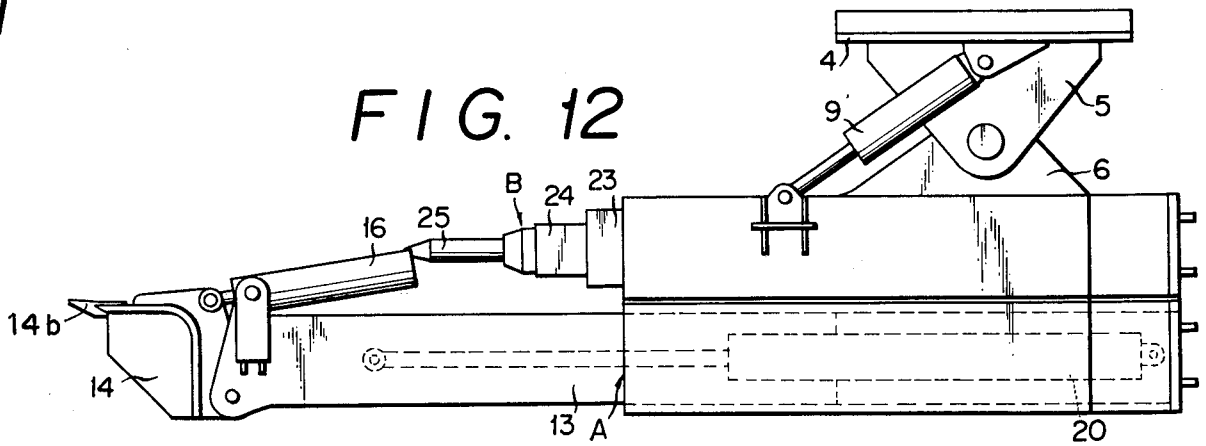
Figure 9:
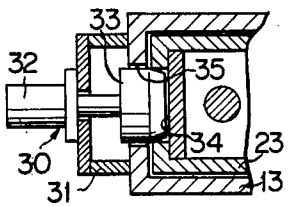
FIG. 9 is a sectional drawing viewed along the IX—IX line shown in FIG. 7.
Figure 11:
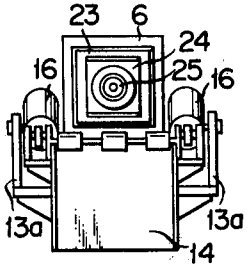
FIG. 11 is an elevation viewed from the direction of XI shown by an arrow in FIG. 10, FIG. 12 and FIG. 13 are explanatory drawings to show the actuation of the ground excavating apparatus introduced in the present invention.
Figure 13:
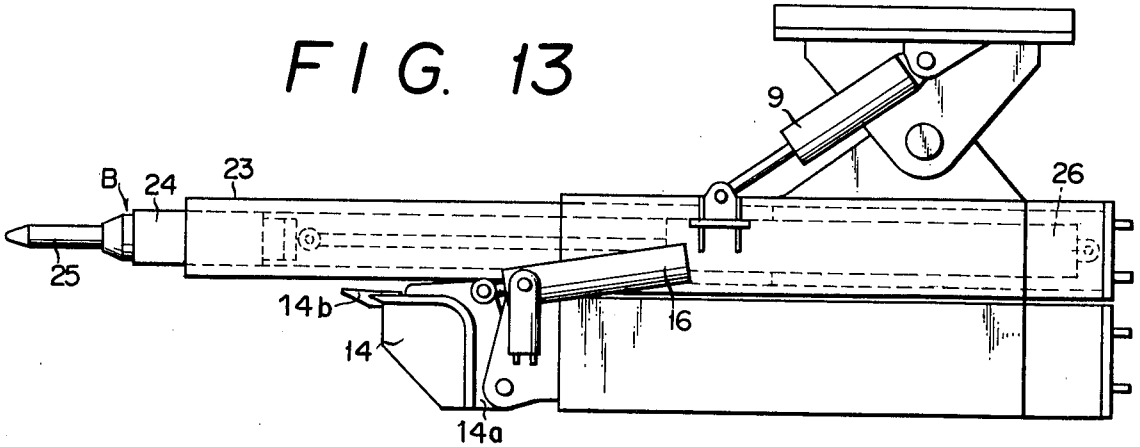

Shown in FIG. 10 through FIG. 13 is another illustration of the present invention, wherein an impact crushing mechanism B is set in place above the bucket boom 13. To put it in more specific terms, the guide boom 23 is so set in place as to be capable of sliding on top of the housing 6 that is fitted in place on the bracket 5 of the swivel seat 4 by means of a pin 7, and the bucket boom 13 is so set in place as to be capable of sliding in the lower section of the housing. Furthermore, jack supports 36, 37 are fixed in place on the top and the bottom of the housing 6 on the rear end section thereof, whereby the supporting member A is thus properly constituted. The said guide boom 23 has the impact-generating mechanism 24 is fixed in place on the front end section thereof, and the said impact-generating mechanism 24 is provided with the chisel 25. The said guide boom 23 has the sliding jack 26 properly set in place therein, and the base end section of the said sliding jack 26 is properly fitted in place on the jack support 36 by means of a pin 38. The rod 26*a* of the sliding jack 26 is fitted on place on the bracket 24*a* on the rear end section of the impact-generating mechanism 24 by means of a pin 39. The said swivel seat 4 has the bracket 8 properly fixed in place thereon, the said bracket 8 has the said jack 9 for actuating the boom to face upward or downward properly fitted in place thereon by means of a pin 10, and the rod 9*a* of the jack 9 for actuating the boom to face upward or downward is properly fitted in place on the bracket 11 set in place on the housing 6, by means of a pin 12. The bucket boom 13 has the bracket 14*a* for the bucket 14 properly fitted in place by means of a pin 15 on the front end section thereof, and, the bucket boom 13 has a supporting bracket 13*a* properly fixed in place on the top end section thereof, the said supporting bracket 13*a* has the bucket jack 16 properly fitted in place thereon by means of a pin 17, and the rod 16*a* of the bucket jack 16 is properly fitted in place on the bracket 14*a* set in place on the back of the said bucket 14 by means of a pin 18. The said bucket boom 13 has the sliding jack 20 properly set in place therein, the base end section of the said sliding jack 20 is properly fitted in place on the jack support 37 by means of a pin 40, and the rod 20*a* of the said sliding jack 20 is properly fitted in place on the bucket boom 13 by means of a pin 41.

Furthermore, excavation of a soft stratum and impact crushing of a hard stratum consisting of a rock bed are to be conducted in the same manner as in the case of the illustration set forth above, so also is raking crushed chips together to be conducted in the same manner.

Figure 15:
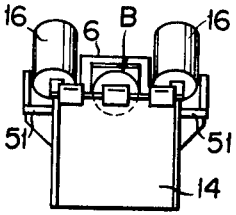
FIG. 15 is an elevation viewed from the direction of XV shown by an arrow in FIG. 14, and FIG. 16 and FIG. 17 are explanatory drawings to show the actuation of the ground excavating apparatus introduced in the present invention.
Figure 14:
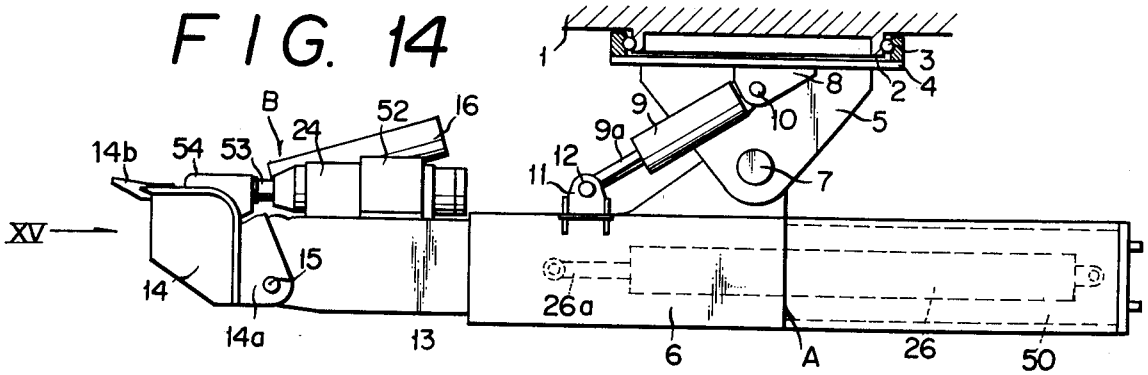
FIG. 14 is a side view of still other illustration of the present invention.
Figure 16:
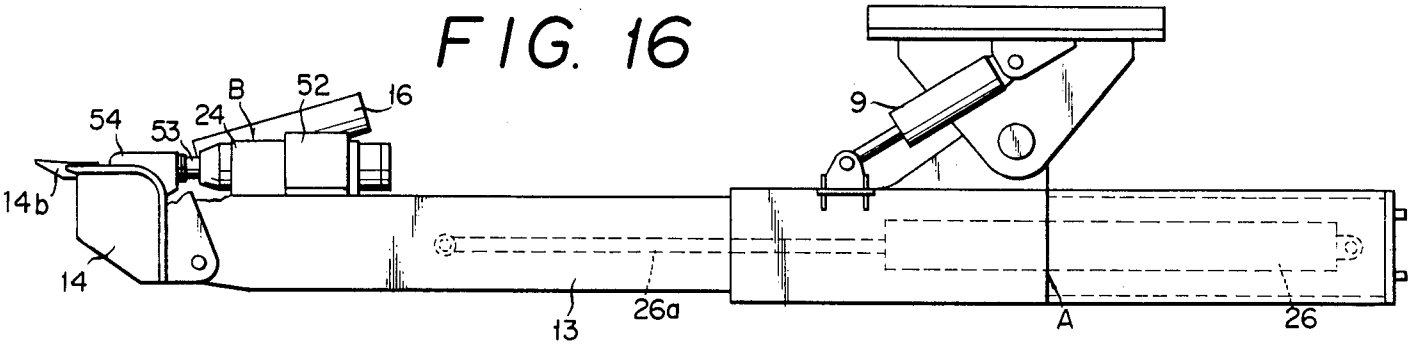
Figure 17:
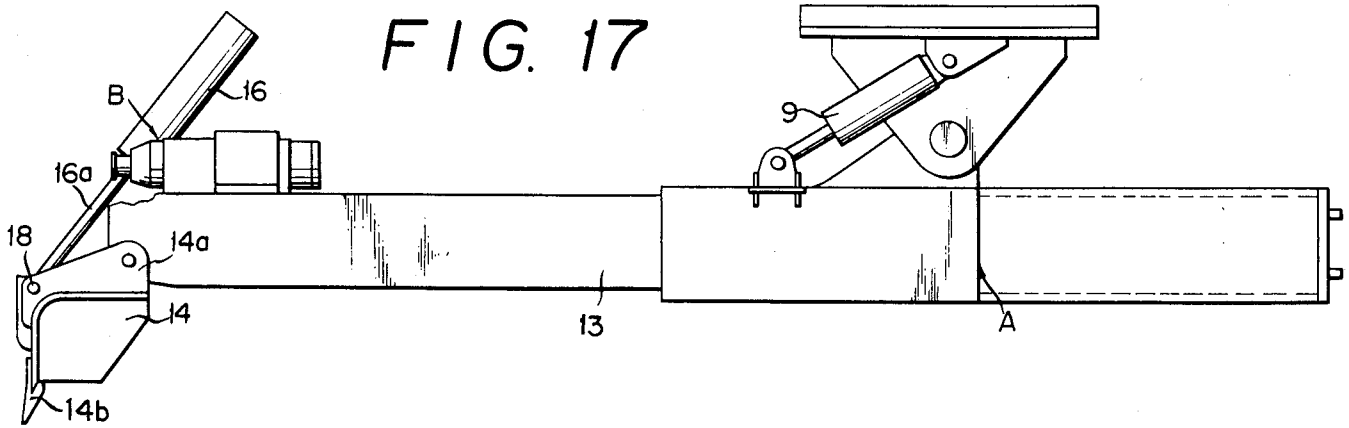

Shown in FIG. 14 through FIG. 17 is still other illustration of the present invention. In the drawings, 1 is a fixed member, the said fixed member 1 has a ring-shaped seat 2 for fitting properly set in place thereon in a projecting manner, and the said seat 2 for fitting properly set in place thereon through a pivoted bearing 3. The said swivel seat 4 has brackets 5, 8 properly fixed in place thereon, and the said bracket 5 has a housing 6 properly fitted thereon by means of a pin 7 in such a manner as to be capable of rocking in the vertical directions. The said housing 6 has a bracket 11 properly fixed in place thereon. The said bracket 8 has a jack 9 for actuating the boom to face upward or downward properly fitted in place thereon by means of a pin 10, and a rod 9*a* of the said jack 9 for actuating the boom to face upward or downward is properly fitted in place on the said bracket 11 by means of a pin 12. The said housing 6 has a jack support 50 properly fixed in place on the rear end section thereof, and the both thereof constitute a supporting member A. The said housing 6 has a bucket boom 13 properly set in place thereon in such a manner as to be capable of sliding in the forward and rearward directions, and the said bucket boom 13 has such a bracket 14*a* as is set in place in the rear of the bucket 14 properly fitted in place on the front end section thereof. The said bucket boom 13 has the supporting brackets thereof 51, 51 properly fixed in place on the right and on the left of the front end section thereof, respectively, the said supporting brackets 51, 51 have bucket jacks 16, 16 properly fitted in place thereon by means of a pin, respectively, and the rods 16*a*, 16*a* of the said bucket jacks 16, 16 are properly fitted in place on such brackets 14*a*, 14*a* as are fixed in place in the rear of the said bucket 14, by means of pins 18, 18, respectively. The said bucket boom 13 has a fixed bracket 52 properly fitted in place on the upper section of the front end thereof, and the said fixed bracket 52 has an impact-generating mechanism 24 properly fixed in place thereon. The said impact-generating mechanism 24 has an impact hammer 53 properly set in place thereon, and the both thereof constitute an impact crushing mechanism B in a proper manner. The said bucket 14 has an impact receiver 54 properly fixed in place on the rear section thereof. The said bucket boom 13 has a sliding jack 26 properly set in place therein, the base end section of the said sliding jack 26 is properly fitted in place on the said jack support 50 by means of a pin, and the rod 26*a* of the said sliding jack 26 is properly fitted in place on the said bucket boom 13 by means of a pin.

Besides, the said pivoted seat 4 is so designed as to be properly caused to swivel by a swivel driving mechanism (not shown in the drawings).

And, in case a proposed stratum is rather soft, the sliding jack 26 is actuated to thus cause the bucket boom 13 to be properly extended, the jack 9 for actuating the boom to face upward or downward is actuated to thus cause the bucket boom 13 to draw near to a proposed portion to be excavated, and the bucket jacks 16, 16 are actuated to thus cause the bucket 14 to be properly rocked, whereby excavation of a proposed stratum is conducted by excavating flukes 14*b* in a proper manner.

When such a hard stratum as a rock bed or the like should be encountered, the bucket jacks 16, 16 are actuated, the excavating flukes 36 are drawn near in such a manner as to be in parallel with the centerline of the axis of the boom, and the impact receiver 54 is caused to come in contact with an impact hammer 53. The impact-generating mechanism 24 is actuated in this state, to thus apply an impact on the bucket 14 by means of the impact hammer 53, whereby the rock bed is subjected to proper impact crushing by the excavating flukes 14*b*.

The chips of the soft stratum thus excavated and the chips of the hard stratum thus subjected to impact crushing are to be raked off position by actuating the bucket jack 16, the sliding jack 26 and the jack 9 for actuating the boom to face upward or downward, then by inclining and rotating the bucket 14.

What is claimed is:

1. A ground excavating apparatus comprising
   a supporting member,
   a bucket boom fitted on said supporting member such that it travels in the forward and rearward directions,
   a bucket fitted on the top end section of the bucket boom such that it can be inclined with respect to the boom, said bucket having a plurality of flukes on the forward end thereof,
   means for impact crushing housed in said bucket boom and capable of traveling in the forward and rearward directions,
   primary means of operation positioned on said supporting member, for operating said bucket boom for causing it to travel forward and rearward,
   secondary means of operation positioned on said bucket boom, for operating said means for impact crushing to cause it to travel forward and rearward, and
   means of operation for inclination positioned on said bucket boom, for inclining said bucket.

2. The ground excavating apparatus set forth in the claim 1 above, wherein said means of impact crushing is housed in a guide boom so positioned in said bucket boom as to be capable of sliding.

3. The ground excavating apparatus set forth in the claim 2 above, wherein said means of impact crushing comprises an impact-generating mechanism as is positioned in said guide boom, and a chisel as is set in place on the top end section of said impact-generating mechanism.

4. The ground excavating apparatus set forth in the claim 2 above, wherein said bucket boom has a locking mechanism which fixes said guide boom thereon.

5. The ground excavating apparatus set forth in the claim 1 above, wherein said primary means of operation and said secondary means of operation each comprise a sliding jack.

6. The ground excavating apparatus set forth in the claim 1 above, wherein said means of operation for inclination is a bucket jack.

7. A ground excavating apparatus comprising
   a vehicle having a mounting bracket thereon;
   a supporting member including a housing pivotally connected to said bracket;

a bucket boom fitted in the housing of said supporting member such that it travels in the forward and rearward directions, a bucket as is fitted in place on the end of the bucket boom such that it can be inclined, means for impact crushing fitted in the housing of said supporting member above said bucket boom, said means of impact crushing traveling in the forward and rearward directions, primary means of operation positioned in said housing, for operating said bucket boom for causing it to travel forward and rearward, secondary means of operation positioned in the housing for operating said means of impact crushing to cause it to travel forward and rearward, and means of operation for inclination positioned on said bucket boom, for inclining said bucket.

8. A ground excavating apparatus comprising a vehicle having a mounting bracket thereon, a supporting member including a housing pivotally connected to said bracket, a bucket boom fitted in the housing of said supporting member such that it travels in the forward and rearward directions, a bucket fitted on the forward end of the bucket boom such that it can be inclined, said bucket including an impact receiver on the rear end thereof, means for impact crushing fitted on the forward end of said bucket boom above said bucket, said means for impact crushing traveling in the forward and rearward directions to strike said impact receiver on said bucket, primary means of operation positioned on said supporting member for operating said bucket boom for causing it to travel forward and rearward, means of operation for inclination positioned on said bucket boom, for inclining said bucket.

* * * * *